United States Patent [19]

Sugasawa et al.

[11] 4,276,863

[45] Jul. 7, 1981

[54] APPARATUS FOR CONTROLLING THE NUMBER OF ENABLED CYLINDERS OF AN INTERNAL COMBUSTION ENGINE UPON DECELERATION

[75] Inventors: Fukashi Sugasawa, Yokohama; Haruhiko Iizuka; Junichiro Matsumoto, both of Yokosuka, all of Japan

[73] Assignee: Nissan Motor Company, Limited, Japan

[21] Appl. No.: 34,285

[22] Filed: Apr. 30, 1979

[30] Foreign Application Priority Data

May 12, 1978 [JP] Japan ..... 53-56892

[51] Int. Cl.[3] ..... F02D 17/00

[52] U.S. Cl. ..... 123/481; 123/325; 123/493; 123/198 F

[58] Field of Search ..... 123/32 EL, 32 EH, 32 EA, 123/198 F, 198 DB, 97 B

[56] References Cited

U.S. PATENT DOCUMENTS

| | | | |
|---|---|---|---|
| 2,875,742 | 3/1959 | Dolza | 123/198 F |
| 3,463,130 | 8/1969 | Reichardt et al. | 123/32 EL |
| 3,727,591 | 4/1973 | Suda | 123/32 EL |
| 4,064,844 | 12/1977 | Matsumoto et al. | 123/32 EL |
| 4,080,947 | 3/1978 | Iizuka | 123/198 F |
| 4,129,109 | 12/1978 | Matsumoto | 123/32 EL |
| 4,172,434 | 10/1979 | Coles | 123/198 F |
| 4,175,534 | 11/1979 | Jordan | 123/97 B |

*Primary Examiner*—Charles J. Myhre
*Assistant Examiner*—Andrew M. Dolinar
*Attorney, Agent, or Firm*—Lane, Aitken, Ziems, Kice & Kananen

[57] ABSTRACT

Apparatus for controlling the number of enabled cylinders of an internal combustion engine during deceleration comprises a plurality of comparators responsive to a signal indicative of the engine rotational speed upon deceleration of the engine. The threshold voltages of the comparators are arranged stepwise so that each comparator produces an output signal when the engine speed falls below each threshold voltage. The output signals of the comparators are supplied to logic circuits to control a plurality of switches via which the fuel injection control pulse signal is respectively applied to fuel injection valves to increase in a stepwise fashion the number of enabled cylinders from the fuel cut-off state thereby preventing occurrence of impacts or shocks in the transition period of reactivation of the cylinders upon deceleration.

20 Claims, 8 Drawing Figures

LOW ← ENGINE SPEED → HIGH

THE NUMBER OF ENABLED CYLINDERS

O : ENABLED CYLINDERS
× : DISABLED CYLINDERS

THE NUMBER OF ENABLED CYLINDERS

O: ENABLED CYLINDERS
×: DISABLED CYLINDERS

THE NUMBER OF ENABLED CYLINDERS

O: ENABLED CYLINDERS
×: DISABLED CYLINDERS

APPARATUS FOR CONTROLLING THE NUMBER OF ENABLED CYLINDERS OF AN INTERNAL COMBUSTION ENGINE UPON DECELERATION

FIELD OF THE INVENTION

This invention generally relates to an apparatus for controlling the number of enabled cylinders of an internal combustion engine. More particularly, the present invention relates to such an apparatus in which the number of enabled cylinders is controlled during deceleration of the engine.

BACKGROUND OF THE INVENTION

In some of the conventional internal combustion engines equipped with a fuel injection mechanism, the fuel supply to all of the cylinders of the engine is cut off upon deceleration until the rotational speed of the crankshaft of the engine falls below a predetermined value such as 1,300 r.p.m. inasmuch as engine output is not required when the throttle valve of the engine is fully closed. This cut-off of fuel supply results in effective engine braking and improvement of its fuel consumption characteristic. In such an engine, the fuel supply is reestablished when the rotational speed of the engine crankshaft falls below the predetermined value in order to prevent engine stall. According to the above mentioned apparatus, since all of the cylinders are enabled (fueled) or disabled (non-fueled) at once depending on whether the rotational speed is above or below the predetermined value, the engine produces an impact or shock which will have an effect on the vehicle body. It will be understood that such an impact or shock is uncomfortable for the vehicle occupants.

Furthermore, the predetermined value at which the reactivation of the engine cylinders takes place has to be set at a relatively high value in order to prevent engine stall. However, this predetermined value is preferably as low as possible to improve fuel economy.

SUMMARY OF THE INVENTION

The present invention has been developed in order to remove the above-mentioned drawbacks and disadvantages inherent to the conventional apparatus.

It is, therefore, an object of the present invention to provide an apparatus for controlling the number of enabled cylinders of an internal combustion engine in which impacts or shocks which are apt to occur in the transition period of reactivation of the cylinders during engine deceleration are diminished.

Another object of the present invention is to provide such an apparatus in which the lowest threshold speed, at which all of the cylinders are enabled, is set lower than in a conventional apparatus.

A further object of the present invention is to provide such an apparatus in which the fuel consumption characteristic is improved.

A still further object of the present invention is to provide such an apparatus in which variation in engine torque is reduced.

An additional object of the present invention is to provide such an apparatus in which the efficiency of engine braking at low engine speeds is increased.

In order to achieve the above objects, the number of enabled cylinders of an internal combustion engine is stepwise increased as the rotational speed of the engine crankshaft decreases during deceleration.

BRIEF DESCRIPTION OF THE DRAWINGS

These and other objects and features of the present invention will become more readily apparent from the following detailed description of the preferred embodiments taken in conjunction with the accompanying drawings in which.

DETAILED DESCRIPTION OF THE PREFERRED EMBODIMENTS

Prior to describing the preferred embodiments of the apparatus for controlling the number of enabled cylinders in accordance with the present invention, a prior art technique will be discussed hereinbelow for a better understanding of the objects of the present invention.

Figure 1:
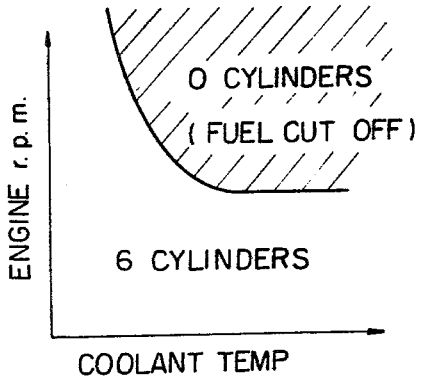
Fig. 1 PRIOR ART
FIG. 1 is a graph showing the threshold at which reactivation of cylinders of an engine occurs in the control of the conventional fuel cut off control system.

FIG. 1 is a graph showing the control of a conventional fuel cut-off control system. It is assumed that an internal combustion engine has six cylinders. The graph shows the threshold at which the deactivation of the cylinders occurs upon deceleration in terms of engine r.p.m. and engine coolant temperature. As the engine r.p.m. falls below the threshold, all of the cylinders (six) are reactivated at once in order to prevent engine stall. This threshold is, however, dependent on the engine temperature which is usually indicated by the engine coolant temperature. As shown in FIG. 1, the threshold increases as the engine temperature decreases. This arrangement is made for obtaining smooth rotation of the engine since the friction coefficient of the lubricant oil is high when the engine is not warmed up enough.

Figure 2:
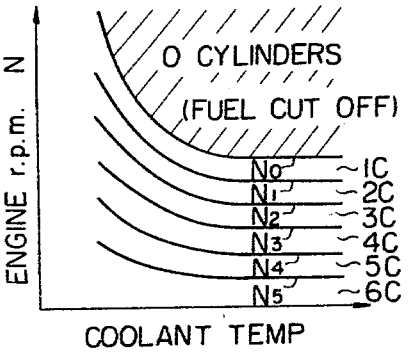
FIG. 2 is a graph showing the threshold at which reactivation of cylinders of an engine stepwise occurs in the control of the apparatus according to the present invention.

According to the present invention, the number of cylinders to be enabled is stepwise controlled in accordance with the engine rotational speed. Two control patterns of the thresholds used in the present invention are respectively shown in FIG. 2 and FIG. 3. As shown in FIG. 2, there are six thresholds. When the deceleration of the engine is detected, all of the cylinders are disabled in the same manner as in the conventional apparatus. However, when the engine rotational speed falls below a first threshold $N_O$, one of the six cylinders is enabled by supplying fuel thereto. When the engine rotational speed further decreases, falling below the second threshold $N_1$, two cylinders are enabled. In the same manner the number of enabled cylinders increases stepwise as the engine rotational speed decreases. When the engine rotational speed falls below the sixth threshold, all of the cylinders are finally enabled to prevent engine stall. These six thresholds are dependent on the engine temperature in the same manner as in the conventional system, namely, the thresholds are substantially parallel with each other in the graph of FIG. 2 throughout the possible temperature range.

Figure 3:
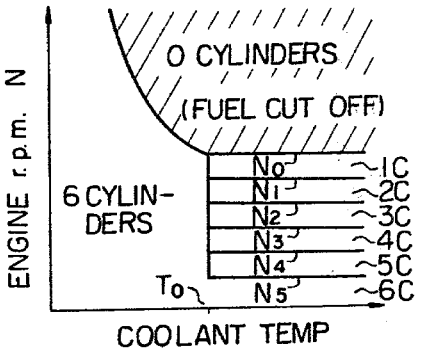
FIG. 3 is a graph showing like thresholds of a different pattern according to the present invention.

Although the thresholds are arranged to vary in accordance with the temperature of the engine (coolant) so as to perform the above-mentioned stepwise control throughout the possible temperature range, such stepwise control may be made only when the engine temperature is above a predetermined value. FIG. 3 shows this control pattern. As shown in FIG. 3, there is a single threshold when the engine temperature is below a predetermined value $T_o$, while there are six predetermined thresholds when the engine temperature is above the predetermined value $T_o$. The apparatus which performs the control patterns respectively shown in FIG. 2 and FIG. 3 will be described hereinbelow in connection with first and second embodiments of the present invention taken in conjunction with FIG. 4 and FIG. 5.

Figure 4:
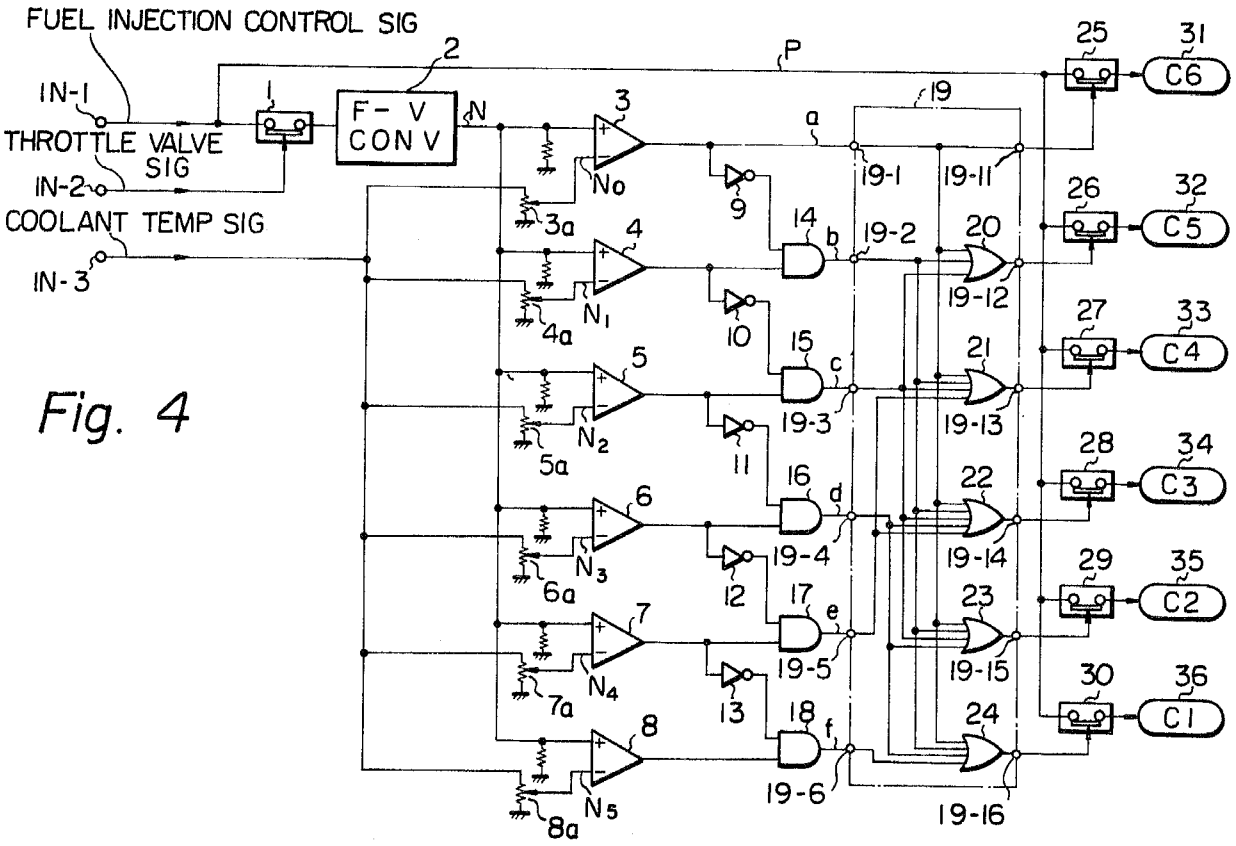
FIG. 4 shows a circuit diagram of a first preferred embodiment of the apparatus according to the present invention for achieving the control of FIG. 2.

Hence, reference is now made to FIG. 4 which shows a schematic circuit diagram of a first preferred embodiment of the apparatus for controlling the number of enabled cylinders according to the present invention. The circuit includes a switch 1, a frequency to voltage (F-V) converter 2, a series of comparators 3 to 8, a series of variable resistors 3*a* to 8*a*, a series of NOT gates (inverters) 9 to 13, a series of AND gates 14 to 18, a decoder 19, and a series of switches 25 to 30. It is assumed that the internal combustion engine (not shown) which is controlled by the circuit shown in FIG. 4 is of a fuel injection type and has six cylinders. Accordingly, six fuel injection valves 31 to 36 are provided in respective intake manifolds communicating with respective cylinders. These fuel injection valves 31 to 36 are respectively controlled by a fuel injection control pulse signal "P" which is generated by a conventional fuel injection control pulse generator (not shown) and this pulse signal "P" is applied to the circuit via a first input terminal IN-1. The series of switches 25 to 30 as well as the switch 1 may be relays or electronic switches. The series of switches 25 to 30 are of normally-closed type and are arranged to open (turn off) in response to gate signals supplied from the decoder 19. In other words, the fuel injection valves 31 to 36 are so controlled by the fuel injection control pulse signal "P" that all of the cylinders are enabled unless gate signals are applied from the decoder 19.

The fuel injection control pulse signal "P" is applied via the switch 1 to an input of the frequency to voltage converter 2. The switch 1 is controlled by a throttle valve signal applied via a second input terminal IN-2. The throttle valve signal is produced by a well known throttle valve opening degree sensor, such as a potentiometer operatively connected to the shaft of the throttle flap (not shown). The output of the throttle valve opening degree sensor is connected to a threshold circuit such as a comparator to produce a high level signal when the opening degree of the throttle flap is below a predetermined value. In other words, a high level signal is applied to the switch 1 to close the contacts thereof only when the throttle valve is fully closed to feed the fuel injection control pulse signal "P" to the input of the frequency to voltage converter 2. The frequency to voltage converter 2 produces an analogue signal indicative of the rotational speed N of the crankshaft of the engine since the frequency of the injection pulse signal "P" represents the engine rotational speed. Of course a suitable signal indicative of the engine r.p.m. may be used in place of the fuel injection control pulse signal P. For instance, an engine r.p.m. signal derived from a tachometer generator may be used.

The output of the frequency to voltage converter 2 is connected to noninverting inputs (+) of the first to sixth comparators 3 to 8. A resistor is interposed between each of the noninverting inputs (+) of each of comparators 3 to 8 and ground. Each of the comparators 3 to 8 has an inverting input (−) connected to the movable contact of each of the variable resistors 3*a* to 8*a*. The variable resistors 3*a* to 8*a* may be voltage dividers having two end terminals and a center tap. Each of the variable resistors 3*a* to 8*a* is interposed between a third input terminal IN-3 and ground. The third input terminal IN-3 is responsive to an engine coolant temperature signal which may be produced by a suitable temperature sensor such as a thermistor disposed in the water jacket of the engine to be exposed to the coolant of the engine. The movable contacts of the respective variable resistors 3*a* to 8*a* are so adjusted that respective predetermined voltages are developed when a predetermined voltage is applied to the third input terminal IN-3. These voltages produced by the series of variable resistors 3*a* to 8*a* are arranged stepwise to be used as stepwise reference or threshold voltages by the comparators 3 to 8. Since the voltage applied to the third input terminal IN-3 indicates the temperature of the engine (coolant), the voltage applied to respective variable resistors 3*a* to 8*a* vary in accordance with the variation of the engine temperature. The reference or threshold voltages are arranged to respectively correspond to predetermined rotational speeds $N_0$ to $N_5$ of the crankshaft of the engine in a manner that the value of $N_0$ is higher than the value of $N_5$. For instance, the threshold voltages are set to correspond to the respective rotational speeds of the engine as follows: $N_0=1{,}300$ r.p.m.; $N_1=1{,}200$ r.p.m.; $N_2=1{,}100$ r.p.m.; $N_3=1{,}000$ r.p.m.; $N_4=900$ r.p.m.; and $N_5=800$ r.p.m. It is to be noted that the circuit shown in FIG. 4 is designed to be used for controlling a six-cylinder engine so that the maximum number of steps in the stepwise control is six. Accordingly, the maximum number of steps in the stepwise control will follow the number of cylinders of an engine. The number of steps in the stepwise control is determined by the number of the comparators 3 to 8 and therefore, the number of the comparators may be increased or decreased in accordance with the number of the cylinders of an engine.

Each of the comparators 3 to 8 produces a high (logic "1") level output signal when the voltage of the signal from the frequency to voltage converter 2 exceeds respective thresholds. In other words, each comparator 3 to 8 produces a high level signal when the rotational speed N of the engine crankshaft exceeds respective threshold speeds $N_0$ to $N_5$ and a low (logic "0") level signal when the rotational speed N is equal to or below the respective threshold speeds $N_0$ to $N_5$. The output of the first comparator 3 is connected to a first input 19-1 of the decoder 19, and is further connected via a first NOT gate 9 to a first input of a first AND gate 14 the output of which is connected to a second input 19-2 of the decoder 19 in turn. The output of the second comparator 4 is connected to a second input of the first AND gate 14 and is further connected via a second NOT gate 10 to a first input of a second AND gate 15 the output of which is connected to a third input 19-3 of the decoder 19. In the same manner the outputs of the third to fifth comparators 5 to 7 are respectively connected to the second to fifth AND gates 15 to 18 the outputs of which are respectively connected to third to sixth inputs 19-3 to 19-6 of the decoder 19. The output of the sixth comparator 8 is connected to a second input of the sixth AND gate 18.

The decoder 19 has the above mentioned six inputs 19-1 to 19-6, five OR gates 20 to 24, and six outputs 19-11 to 19-16. The first input 19-1 is directly connected to the first output 19-11 and is further connected to an input of all of the OR gates 20 to 24. The second input 19-2 of the decoder 19 is connected to an input of each of the OR gates 20 to 24, while the third input 19-3 is connected to inputs of first to fourth OR gates 20 to 23. The fourth input 19-4 is connected to inputs of third to fifth OR gates 22 to 24, while the fifth input 19-5 is connected to inputs of the second and third OR gates 21 and 22. The sixth input 19-6 is connected to an input of the fifth OR gate 24. The outputs of the first to fifth OR gates 20 to 24 are respectively connected to the second to sixth outputs 19-12 to 19-16 of the decoder 19. The first to sixth outputs 19-11 to 19-16 of the decoder 19 are respectively connected to first to sixth switches 25 to 30 to control the switching operation of the same.

The circuit shown in FIG. 4 operates as follows. It is assumed that the throttle valve is fully closed so that the switch 1 is closed to transmit the fuel injection control pulse signal "P" to the frequency to voltage converter 2. The voltage of the output signal of the frequency to voltage converter 2 indicates the rotational speed N of the crankshaft of the engine and this signal is applied to all of the comparators 3 to 8. When the rotational speed of the engine is above the first threshold rotational speed $N_0$, i.e. the frequency to voltage converter output voltage is over the highest threshold voltage fed from the first variable resistor 3*a*, all of the comparators 3 to 8 produce high (logic "1") level output signals. This high level output signal of the first comparator 3 is applied to the first input 19-1 of the decoder 19 so that the decoder 19 produces high level output signals at all of the outputs 19-11 to 19-16. These high level signals from the decoder 19 are respectively applied to the switches 25 to 30 as gate signals to open (turn off) the contacts thereof. Consequently, the fuel injection control pulse signal "P" is not fed to the respective fuel injection valves 31 to 36 and therefore, the fuel supply to all cylinders of the engine is disabled. Of course if the throttle valve is not fully closed, the switch 1 remains open and therefore, the frequency to voltage converter 2 produces an output analogue signal of low voltage. In this case none of the comparators 3 to 8 produces high level output signals so that all of the switches 25 to 30 are left closed to transmit the fuel injection control pulse signal "P" to the fuel injection valves 31 to 36. Accordingly, fuel cut-off (deactivation) takes place only when the throttle valve is fully closed i.e. upon deceleration. The operation of the circuit will be described hereinbelow under an assumption that the switch 1 is closed upon detection of deceleration of the engine.

As the rotational speed of the crankshaft of the engine decreases and when the speed falls below the first threshold speed $N_0$ and the second threshold speed $N_1$, the output signal of the first comparator 3 assumes a low (logic "0") level, while the remaining comparators 4 to 8 still produce high level output signals. The low level output signal of the first comparator 3 is inverted into a high level signal by the first NOT gate 9 and applied to the first input of the first AND gate 14. Since the first AND gate 14 receives a high level output signal from the second comparator 4, the AND gate 14 transmits a high level signal to the second input 19-2 of the decoder 19. The high level signal applied to the second input 19-2 of the decoder 19 is delivered via the first to fifth OR gates 20 to 24 to the second to six outputs 19-12 to 19-16 of the decoder 19, while a low level output signal is developed at the first output 19-11. Accordingly, only the first switch 25 is turned on to permit the transmission of the fuel injection control pulse signal "P". With this operation, the fuel supply to the sixth cylinder C6 is reestablished, i.e. the sixth cylinder C6 is enabled, while the remaining cylinders C1 to C5 are left disabled.

When the engine crankshaft rotational speed N further decreases to between the second threshold speed $N_1$ and the third threshold speed $N_2$, the first and second comparators 3 and 4 produce low level output signals, while the remaining comparators 5 to 8 produce high level output signals. In this case only the second AND gate 15 produces a high level output signal and this high level signal is fed to the third input 19-3 of the decoder 19. The high level signal applied to the third input 19-3 is transmitted via the first to fourth OR gates 20 to 23 to the second to fifth outputs 19-12 to 19-15. Therefore, the first and sixth switches 25 and 30 are closed while second to fifth switches 26 to 29 remain open. Accordingly, the first and sixth cylinders C1 and C6 are enabled, while the remaining cylinders C2 to C5 are prevented from being supplied with fuel. In this way the number of enabled cylinders increases as the rotational speed of the crankshaft of the engine decreases upon deceleration. After the engine speed N has finally reached the sixth threshold speed $N_5$, all of the cylinders C1 to C6 are supplied with fuel so that all of the cylinders are enabled to produce respective torque.

Figure 6:
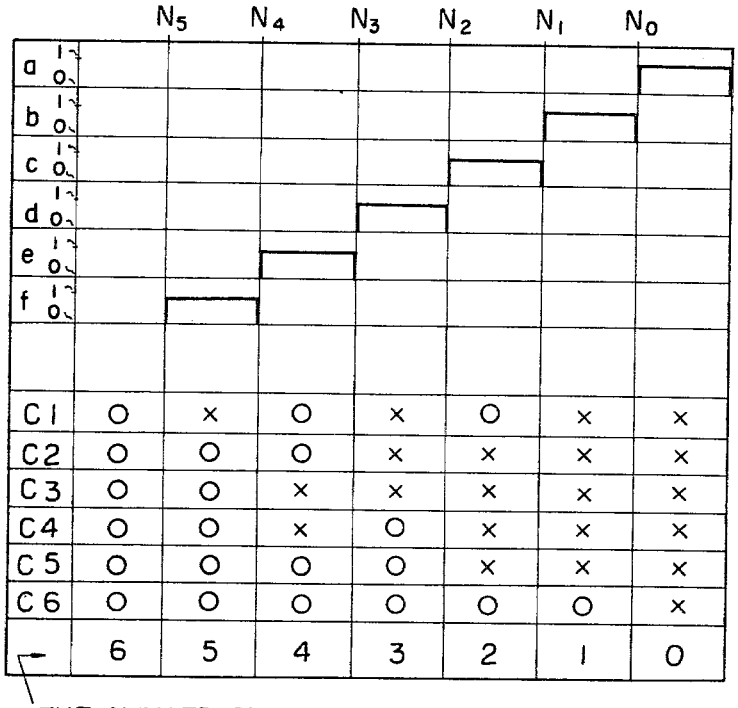
FIG. 6 is a table showing the stepwise reactivation of cylinders of an internal combustion engine, which reactivation is obtained by the first embodiment shown in FIG. 4.

FIG. 6 is a table showing the stepwise reactivation of cylinders with respect to the engine speed. In FIG. 6 the high and low levels of the input signals "a" to "f" of the decoder 19 are also shown. Symbols O indicate activation of the cylinders, while the other symbols X indicate deactivation (fuel cut-off) of the cylinders. As indicated at the bottom of the table of FIG. 6, the number of enabled cylinders increases to 1, 2, 3 . . . , 6 as the engine speed decreases. However, it is to be noted that a specific cylinder which has been enabled is not necessarily enabled when the engine speed further decreases. For instance, although the first cylinder C1 is supplied with fuel when the engine speed N is between the second and third threshold speeds $N_1$ and $N_2$, the first cylinder C1 is disabled when the engine speed N further falls below the third threshold speed $N_2$ but is above the fourth threshold speed $N_3$. Instead of the first cylinder C1 the fourth and fifth cylinders C4 and C5 are enabled in addition to the sixth cylinder C6. This arrangement of reactivation of cylinders is advantageous in order to obtain smooth rotation of the engine. The specific stepwise control pattern of FIG. 6 is made under an assumption that the firing order of the six cylinders C1 to C6 of the engine is as follows:

$$C1 \rightarrow C5 \rightarrow C3 \rightarrow C6 \rightarrow C2 \rightarrow C4.$$

With the specific pattern of FIG. 6, the stepwise fuel supply with respect to the firing order will be seen in the following table.

| FIRING ORDER | LOW ← ENGINE SPEED → HIGH | | | | | | |
|---|---|---|---|---|---|---|---|
| | $N_5$ | $N_4$ | $N_3$ | $N_2$ | $N_1$ | | $N_0$ |
| C1 | O | X | O | X | O | X | X |
| C5 | O | O | O | O | X | X | X |
| C3 | O | O | X | X | X | X | X |
| C6 | O | O | O | O | O | O | X |
| C2 | O | O | O | X | X | X | X |
| C4 | O | O | X | O | X | X | X |
| The number of enabled cylinders | 6 | 5 | 4 | 3 | 2 | 1 | 0 |

O: Enabled cylinders
X: Disabled cylinders

It will be understood that the above table is made by rearranging the table of FIG. 6. As will be understood from the above table, the order of activation of cylinders is performed regularly with respect to time. In other words, the activation of cylinders takes place with a predetermined interval. For instance, when two cylinders, i.e. the first and sixth cylinders C1 and C6, are enabled, each combustion or injection is spaced by two consecutive ignition pulses. Thus as combustions occur at regularly spaced intervals irrespectively of the number of enabled cylinders, the torque output of the engine crankshaft due to the activated or enabled cylinders is relatively smooth. It will be understood that this arrangement of the average delivery of the engine torque prevents the occurrence of fluctuation in the engine output along the crankshaft of the engine.

The fifth threshold speed $N_5$ is set above the lowest possible speed so that all of the cylinders are supplied with fuel when the engine crankshaft rotates at the lowest possible speed, such as the idling speed. With this arrangement the engine rotates smoothly during idling, while the tendency of engine stall is avoided.

Figure 7:
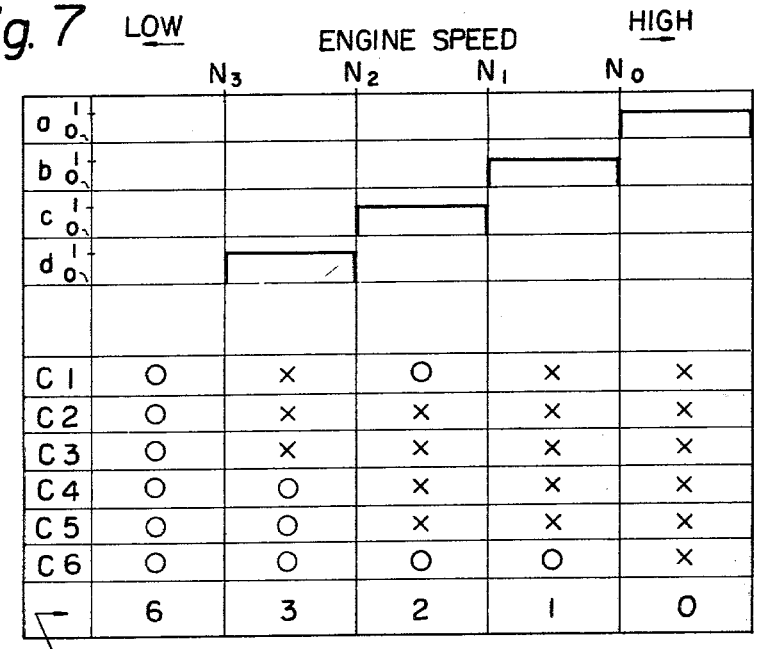
FIG. 7 is a table showing like stepwise reactivation in which the number of steps is decreased compared to that shown in FIG. 6.
Figure 8:
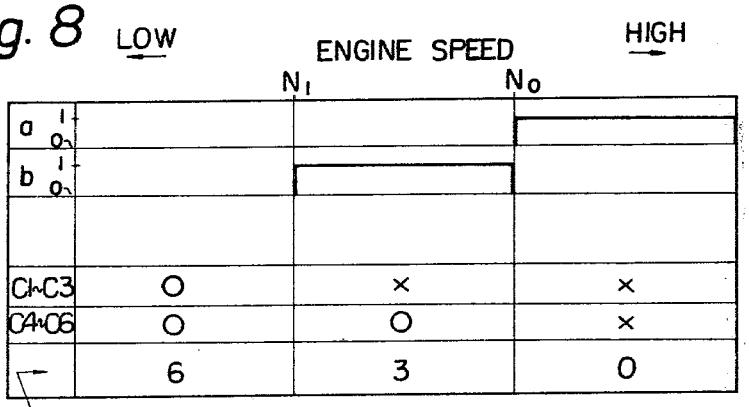
FIG. 8 is a table showing like stepwise reactivation in which the number of steps is further decreased compared to that shown in FIG. 7.

Although the circuit shown in FIG. 4 performs the stepwise activation of the cylinders in six steps, the number of steps may be reduced if desired even though the engine has six cylinders. FIGS. 7 and 8 show other possibilities of stepwise control according to the present invention. In FIG. 7 four-step control is shown, while in FIG. 8 three-step control is shown. When the number of steps of the stepwise control is reduced from the maximum number of steps which corresponds to the number of the cylinders, the number of comparators may be reduced as much as the decreased steps. In detail, when it is desired to perform the stepwise control as shown in FIG. 7, only four comparators 3 to 6 are required and in case that it is desired to perform the stepwise control as shown in FIG. 8, only two comparators 3 and 4 are needed. Furthermore, when it is intended to change the combination of cylinders to be enabled, the wiring in the decoder 19 may be changed. For instance, when it is intended to supply fuel to two cylinders, there are several possible combinations of specific cylinders, such as the combination of the first and sixth cylinders C1 and C6 or the combination of the second and fourth cylinders C2 and C4. These combinations of specific cylinders for each step will be determined in consideration of the firing order of the cylinders.

Figure 5:
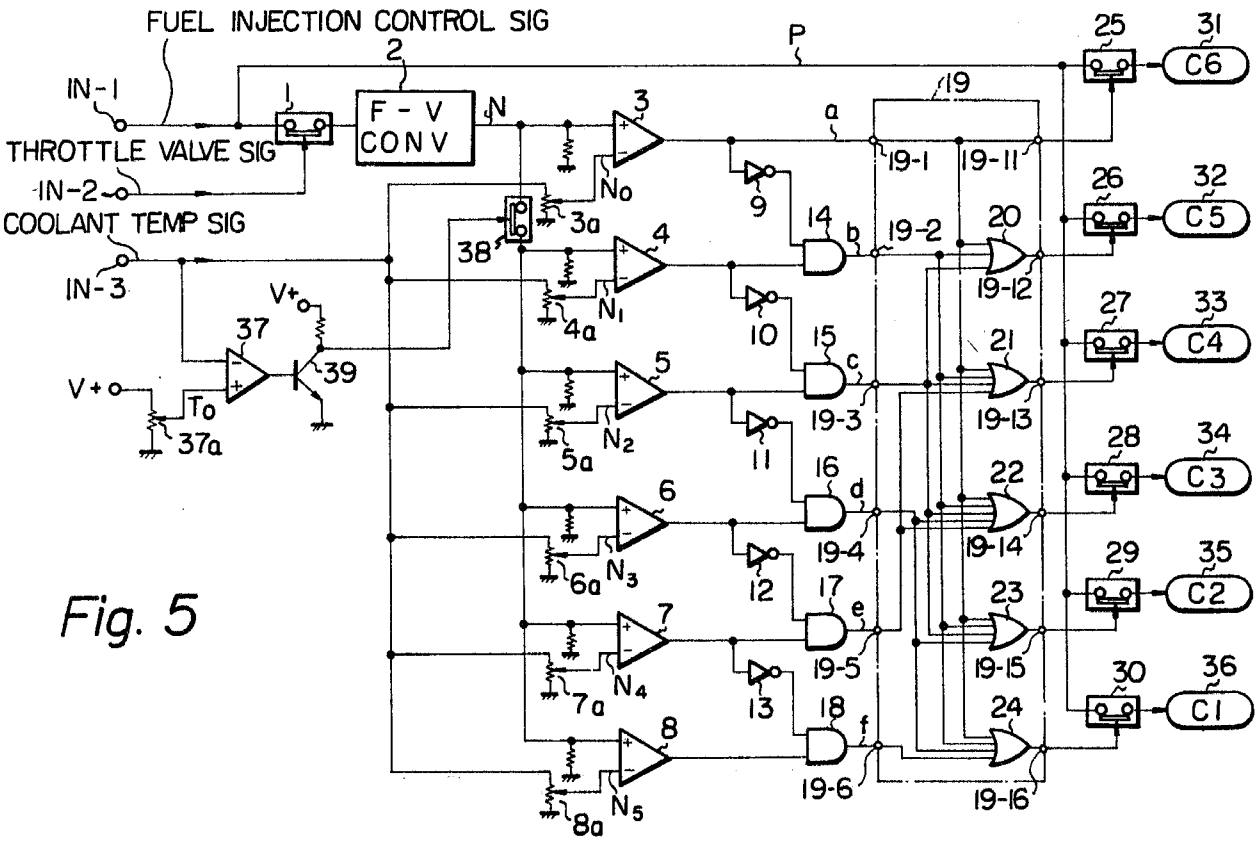
FIG. 5 shows a schematic circuit diagram of a second preferred embodiment of the apparatus according to the present invention for achieving the control of FIG. 3.

Reference is now made to FIG. 5 which shows a second preferred embodiment of the apparatus for controlling the number of enabled cylinders according to the present invention. The second embodiment apparatus is provided for performing a stepwise control such as shown in FIG. 3. The circuit arrangement of the second embodiment is the same as that of the first embodiment except that a switch 38 is interposed in the input circuits of the second to sixth comparators 4 to 8. This switch 38 is controlled by a switching control signal produced in a switching control circuit which is also additionally provided. Other elements and circuits in the second embodiment are the same as those in the first embodiment and these elements and circuits are designated by the same reference numerals.

The switching control circuit includes a comparator 37 and a switching transistor 39. The comparator 37 has an inverting input (−) connected to the third input IN-3 and a noninverting input (+) connected to a voltage divider or a variable resistor 37*a*. The output of the comparator 37 is connected to a base of the transistor 39 the emitter of which is connected to ground. The collector of the transistor 39 is connected via a resistor to a positive power supply V+. The variable resistor 37*a* is interposed between the positive power supply V+ and ground to develop a predetermined reference voltage at the movable contact thereof. This predetermined voltage is fed to the non-inverting input (+) of the comparator 37. The collector of the transistor 39 is connected to the switch 38 to control the switching function thereof. The switch 38 may be a relay or an electronic switching device.

The second embodiment apparatus shown in FIG. 5 operates as follows. In the following description of the operation, only the different points with respect to the first embodiment will be described. When the engine temperature is extremely low, the voltage of the engine coolant temperature signal is high. When the voltage of the coolant temperature signal is above the predetermined voltage applied to the noninverting input (+) of the comparator 37, the comparator 37 produces a low (logic "0") level signal. This predetermined voltage is so set by the variable resistor 37*a* that it corresponds to a predetermined temperature $T_o$ which is shown in FIG. 3. With this provision, the comparator 37 produces a low level signal only when the engine temperature is below the predetermined temperature $T_o$.

The low level signal from the comparator 37 is supplied to the base of the transistor 39 to render the transistor 39 nonconductive (OFF). Upon turning off the transistor 39, the voltage at the collector of the transistor 39 rises so that a high level signal is applied to the switch 38 to turn off the same. The switch 38 becomes nonconductive to block the transmission of the output signal, indicative of the engine rotational speed N, of the frequency to voltage converter 2 to the second to sixth comparators 4 to 8. In other words, only the first comparator 3 receives the output signal of the frequency to voltage converter 2. The first comparator 3, therefore, detects whether the engine rotational speed N is above or below the first threshold speed $N_O$ to produce a high or low level signal in the same manner as in the first embodiment. Meanwhile, the second to sixth comparators 4 to 8 produce low (logic "0") level signals upon receiving no input signals at the noninverting inputs (+) thereof. Accordingly, the first to fifth AND gates 14 to 18 produce low level signals "b" to "f" in receipt of low level signals from the second to sixth comparators 4 to 8. Namely, the input signals "a" to "f" of the decoder 19 will be expressed in logic levels as 1-0-0-0-0-0 when the engine rotational speed N is above the first threshold speed $N_O$; and as 0-0-0-0-0-0 when the engine rotational speed N is equal to or below the first threshold speed $N_O$. Therefore, the output signals of the decoder 19 assume either 1-1-1-1-1-1 or 0-0-0-0-0-0 depending on the engine rotational speed N. This means that all of the cylinders are either supplied with fuel or not depending on the engine r.p.m. when the coolant temperature is below the before mentioned predetermined value $T_o$ upon deceleration.

On the other hand when the coolant temperature is above the predetermined value $T_o$, the comparator 37 produces a high level signal to make the transistor 39 conductive (ON) so that the switch 38 is turned on to supply the output signal of the frequency to voltage converter 2 to the second to sixth comparators 4 to 8. In this temperature range, i.e. above the predetermined value $T_o$, the first to sixth comparators 3 to 8 function in the same manner as in the first embodiment to stepwise increase the number of enabled cylinders as the rotational speed of the engine decreases. This operation will be seen in FIG. 3.

The number of steps in the stepwise control may be decreased in the same manner as described hereinbefore in connection with FIG. 7 and FIG. 8. Furthermore, the construction of the decoder 19 may be changed to provide a different combination of specific cylinders to be enabled in each step.

What is claimed is:

1. Apparatus for controlling the number of enabled cylinders of an internal combustion engine having a plurality of cylinders during deceleration, comprising:

(a) first means for producing a first signal indicative of the rotational speed of a crankshaft of said engine;

(b) second means for producing a second signal indicative of deceleration of said engine;

(c) a plurality of threshold detecting circuits having respective inputs and outputs, said inputs being connected to said first means for producing respective output signals responsive to said first signal at each of said outputs, the thresholds of said detecting circuits being arranged stepwise;

(d) a plurality of switching means responsive to the output signals of said threshold detecting circuits for stepwise increasing the number of enabled cylinders as said engine decelerates;

(e) third means responsive to said second signal for enabling the stepwise increase upon deceleration of said engine; and (f) means for varying the thresholds of said threshold detecting circuits in accordance with the engine temperature.

2. Apparatus as claimed in claim 1, wherein said first means comprises: (a) means for producing a pulse signal responsive to the rotational speed of a crankshaft of said engine; and (b) a frequency to voltage converter resonsive to said pulse signal for producing said first signal.

3. Apparatus as claimed in claim 1, wherein said second means comprises a potentiometer operatively connected to a throttle valve of said engine.

4. Apparatus as claimed in claim 1, wherein each of said threshold detecting circuits comprises a comparator and a voltage divider for producing a reference signal for said comparator.

5. Apparatus as claimed in claim 1, wherein a fuel injection valve enabled by a respective switching means is disposed in an intake passage communicating with each cylinder.

6. Apparatus as claimed in claim 5, further comprising means for generating a fuel injection control pulse signal wherein each of said switching means comprises an electronic switch connected to said each fuel injection valve for switching said fuel injection control signal.

7. Apparatus as claimed in claim 1, further comprising logic circuits interposed between said threshold detecting circuits and said switching means for producing a plurality of combinations of logic signals by which said switching circuits are controlled.

8. Apparatus as claimed in claim 7, wherein said threshold detecting circuits comprise first to sixth comparators, and wherein said logic circuits comprise:

(a) first to fifth NOT gates respectively connected to the outputs of said first to fifth comparators;

(b) first to fifth AND gates, each of which has first and second inputs, the first inputs of said first to fifth AND gates being connected respectively to the outputs of said first to fifth NOT gates, the second inputs of said first to fifth AND gates being connected respectively to the outputs of said second to sixth comparators;

(c) first to fifth OR gates, the output of said first comparator being connected to inputs of said first to fifth OR gates, the output of said first AND gate being connected to inputs of said first to fifth OR gates, the output of said second AND gate being connected to inputs of said first to fourth OR gates, the output of said third AND gate being connected to inputs of said third to fifth OR gates, the output of said fourth AND gate being connected to inputs of said second and third OR gates, the output of said fifth AND gate being connected to an input of said fifth OR gate, the output of said first comparator and the outputs of said first to fifth OR gates being respectively connected to said switching means.

9. Apparatus for controlling the number of enabled cylinders of an internal combustion engine having a plurality of cylinders during deceleration, comprising:

(a) first means for producing a first signal indicative of the rotational speed of a crankshaft of said engine;

(b) second means for producing a second signal indicative of deceleration of said engine;

(c) a plurality of threshold detecting circuits having respective inputs and outputs, said inputs being connected to said first means for producing respective output signals reponsive to said first signal at each of said outputs, the thresholds of said detecting circuits being arranged stepwise;

(d) a plurality of switching means respectively responsive to the output signals of said threshold detecting circuits for stepwise increasing the number of enabled cylinders as said engine decelerates;

(e) third means responsive to said second signal for enabling the stepwise increase upon deceleration of said engine; and (f) logic circuits interposed between said threshold detecting circuits and said switching means for producing a plurality of combinations of logic signals by which said switching means are controlled, wherein said threshold detecting circuits comprise first to sixth comparators, and wherein said logic circuits comprise:

(i) first to fifth NOT gates respectively connected to the outputs of said first to fifth comparators;

(ii) first to fifth AND gates, each of which has first and second inputs, the first inputs of said first to fifth AND gates being connected respectively to the outputs of said first to fifth NOT gates, the second inputs of said first to fifth AND gates being connected respectively to the outputs of said second to sixth comparators;

(iii) first to fifth OR gates, the outputs of said first comparator being connected to inputs of said first to fifth OR gates, the output of said first AND gate being connected to inputs of said first to fifth OR gates, the output of said second AND gate being connected to inputs of said first to fourth OR gates, the output of said third AND gate being connected to inputs of said third to fifth OR gates, the output of said fourth AND gate being connected to inputs of said second and third OR gates, the output of said fifth AND gate being connected to an input of said fifth OR gate, the output of said first comparator and the outputs of said first to fifth OR gates being respectively connected to said switching means.

10. Apparatus for controlling the number of enabled cylinders of an internal combustion engine having a plurality of cylinders during deceleration, comprising:

(a) first means for producing a first signal indicative of the rotational speed of a crankshaft of said engine;

(b) second means for producing a second signal indicative of deceleration of said engine;

(c) a plurality of threshold detecting circuits having respective inputs and outputs, said inputs being connected to said first means for producing respective output signals responsive to said first signal at each of said outputs, the thresholds of said detecting circuits being arranged stepwise;

(d) a plurality of switching means respectively responsive to the output signals of said threshold detecting circuits for stepwise increasing the number of enabled cylinders as said engine decelerates;

(e) third means responsive to said second signal for enabling the stepwise increase upon deceleration of said engine;

(f) means for disabling the stepwise increase when the engine temperature is below a predetermined value, wherein said disabling means comprises a temperature detecting circuit for producing an output signal when the engine temperature is below a predetermined value and a switching circuit responsive to the output signal of said temperature detecting circuit, said switching circuit being interposed in the input circuits of said threshold detecting circuits except one threshold detecting circuit whose threshold speed is the highest.

11. Apparatus for controlling the number of enabled cylinders of an internal combustion engine having a plurality of cylinders during deceleration, comprising:

(a) first means for producing a first signal responsive to the rotational speed of a crankshaft of said engine;

(b) second means for producing a second signal indicative of deceleration of said engine;

(c) third means responsive to said first signal for producing a plurality of control signals the number of which varies progressively in response to said first signal;

(d) fourth means responsive to said second signal for enabling said third means to produce said control signals upon deceleration of said engine; and (e) a plurality of switching means respectively responsive to each of said control signals for respectively disabling each of said cylinders, wherein said first means comprises:

(i) means for producing a pulse signal responsive to the rotational speed of a crankshaft of said engine; and (ii) a frequency to voltage converter responsive to said pulse signal for producing said first signal, and wherein said fourth means comprises a switching means responsive to said second signal disposed between said means for producing a pulse signal and said frequency to voltage converter.

12. Apparatus for controlling the number of enabled cylinders of an internal combustion engine having a plurality of cylinders during deceleration, comprising:

(a) first means for producing a first signal responsive to the rotational speed of a crankshaft of said engine;

(b) second means for producing a second signal indicative of deceleration of said engine;

(c) third means responsive to said first signal for producing a plurality of control signals the number of which varies progressively in response to said first signal;

(d) fourth means responsive to said second signal for enabling said third means to produce said control signals upon deceleration of said engine; and (e) a plurality of switching means respectively responsive to each of said control signals for respectively disabling each of said cylinders, wherein said third means comprises:

(i) an analog to digital converter responsive to said first signal for producing coded digital output signals in which said rotational speed of the crankshaft is classified into a plurality of sections corresponding to the number of said cylinders; and (ii) a decoding means responsive to said coded digital output signals for producing a plurality of control signals according to a predetermined decoding process wherein the number of said control signals varies in respect to said rotational speed of the crankshaft.

13. Apparatus as claimed in claim 11 or 12, wherein said second means comprises a potentiometer operatively connected to a throttle valve of said engine.

14. Apparatus as claimed in claim 11 or 12, wherein a fuel injection valve enabled by a respective swithing means is disposed in an intake passage communicating with each cylinder.

15. Apparatus as claimed in claim 14, further comprising means for generating a fuel injection control pulse signal wherein each of said switching means comprises an electronic switch connected to said each fuel injection valve for switching said fuel injection control pulse signal.

16. Apparatus as claimed in claim 12, wherein said first means comprises:

(a) means for producing a pulse signal responsive to the rotational speed of a crankshaft of said engine; and (b) a frequency to voltage converter responsive to said pulse signal for producing said first signal.

17. Apparatus as claimed in claim 12 wherein said analog to digital converter comprises:

(a) a plurality of voltage dividers the number of which being equal to the number of said cylinders, and the output voltage thereof being arranged stepwise;

(b) a plurality of comparators, each having inverting and non-inverting inputs, the number of which being equal to the number of said cylinders, and each of the non-inverting inputs thereof being commonly connected to the output of said first means, and each of the inverting inputs thereof being connected to the outputs of respective said voltage dividers;

(c) a plurality of NOT gates rspectively connected to the outputs of said comparators except the last one thereof; and (d) a plurality of AND gates, each of which has first and second inputs, the first inputs thereof being connected respectively to the outputs of said NOT gates, the second inputs thereof being connected respectively to the outputs of said comparators except the first one thereof.

18. Apparatus as claimed in claim 17, wherein said analog to digital converter comprises first to sixth comparators and first to fifth and gates, and wherein said decoding means comprises first to fifth OR gates, the output of said first comparator being connected to inputs of said first to fifth OR gates, the output of said first AND gate being connected to inputs of said first to fifth OR gates, the output of said second AND gate being connected to inputs of said first to fourth OR gates, the output of said third AND gate being connected to inputs of said third to fifth OR gates, the output of said fourth AND gate being connected to inputs of said second and third OR gates, the output of said fifth AND gate being connected to an input of said fifth OR gate, the output of said first comparator and the outputs of said first to fifth OR gates being respectively connected to said switching means.

19. Apparatus as claimed in claim 17 further comprising means for shifting the voltage levels of said voltage dividers in accordance with engine temperature.

20. Apparatus as claimed in claim 17 further comprising means for disabling a stepwise increase of the enabled cylinders when the engine temperature is below a predetermined value comprising:

(a) a temperature detecting means for producing an output signal when the engine temperature is below a predetermined value and (b) a switching circuit responsive to the output signal of said temperature detecting means, said switching circuit being interposed in the input circuit of said comparators except one comparator whose threshold level is the highest.

* * * * *